US005800674A

United States Patent [19]

Iivonen et al.

[11] Patent Number: 5,800,674

[45] Date of Patent: Sep. 1, 1998

[54] METHOD AND APPARATUS FOR IMPROVING A BATCH COOKING PROCESS

[75] Inventors: Mauno Iivonen, Joutseno; Arto Koso; Olavi Pikka, both of Karhula; Seppo Pursiainen; Esko Turunen, both of Joutseno, all of Finland

[73] Assignees: Ahlstrom Machinery Oy, Helsinki; Metsa-Botnia Ab Joutseno Pulp, Pulp, both of Finland

[21] Appl. No.: 742,915

[22] Filed: Nov. 1, 1996

[30] Foreign Application Priority Data

Nov. 1, 1995 [FI] Finland ..... 955241

[51] Int. Cl.[6] ..... D21C 7/08

[52] U.S. Cl. ..... 162/52; 162/60; 162/233; 162/241; 162/242; 162/246

[58] Field of Search ..... 162/52, 60, 61, 162/233, 241, 242, 246, 82, 83, 90, 247

[56] References Cited

U.S. PATENT DOCUMENTS

| | | | |
|---|---|---|---|
| 1,814,027 | 7/1931 | Dunbar | 162/61 |
| 1,818,913 | 8/1931 | Van De Carr, Jr. | 162/52 |
| 4,138,311 | 2/1979 | Neno | 162/28 |
| 4,814,042 | 3/1989 | MacLeod et al. | 162/17 |

OTHER PUBLICATIONS

Cyr et al "Stronger Kraft Softwood Pulp —Achieved!", TAPPI Journal, Oct., 1989, pp. 157–163.

*Primary Examiner*—Donald E. Czaja
*Assistant Examiner*—Steven B. Leavitt
*Attorney, Agent, or Firm*—Nixon & Vanderhye P.C.

[57] ABSTRACT

A method and apparatus for improving a batch cooking process, e.g. providing about 7% increase in discharge time, are provided. The invention is especially suitable for improving modern displacement batch cooking processes. A dedicated pump is mounted directly to each digester and discharges to a common superatmospheric pressure discharge tank.

16 Claims, 5 Drawing Sheets

METHOD AND APPARATUS FOR IMPROVING A BATCH COOKING PROCESS

BACKGROUND AND SUMMARY OF THE INVENTION

The present invention relates to a method and apparatus for improving a batch cooking process. The method and apparatus according to the invention are especially suitable for improving for example modern Superbatch and RDH processes, i.e. according to the invention displacement batch cooking processes. The improvement is related to removal of the cooked pulp from a digester.

In a known manner, a batch cooking system comprises a set of digesters (most often 5–10), in which chips are cooked into pulp. From the digesters, the pulp is discharged into a blow tank, from which it is led further either directly to a paper machine or alternatively to a chemical pulp machine through various washing, screening and bleaching stages. The pulp is discharged from each digester unit to a pipe line shared by several digesters, which pipe line leads to the blow tank. The prior art includes a few different methods of removing pulp from a digester. Previously, when applying older batch cooking methods, the pulp was removed from the digester as a so called hot blow, meaning that the pulp was removed at cooking temperature, whereby there was relatively high pressure in the digester, which resulted in the pulp being discharged from the digester "by itself". Later, batch cooking processes being modified in such a way that the pulp was washed at the final stage of a cook, the pulp was cooled during the wash so that virtually no pressure was present to facilitate removal of the pulp from the digester any longer. Hereby a pressure medium (see EP patent publication 0 420 791) was introduced or removal of the pulp from the digester, the medium being most often compressed air, by means of which the pulp was blown into a blow line. Conventionally, the blow line is provided with one pump for several digesters, by means of which all the pulp in the line is pumped into the blow tank.

The latest prior art method for discharging pulp from a digester is discussed in the article "Stronger kraft softwood pulp—achieved!" in Tappi Journal, October 1989, by Cyr, Embley and MacLeod. The same process has been disclosed in the U.S. Pat. No. 4,814,042. As the title describes, the goal of the development has been to enable production of stronger pulp. The article discusses experiments with three different ways of discharging pulp from a digester. The tested methods were so called hot blowing, cold blowing and pumping with a centrifugal pump arranged below the digester. The results indicated that the last method was by far the best in view of the strength of the pulp. The technical solution used for discharging the pulp from the digester was such that the digester outlet was provided with a gate valve which was followed by an inlet piping for the centrifugal pump mounted on the floor below the digester.

Prior art apparatus induce many problems. Firstly, when emptying the digester, the intention is to dilute the pulp into a consistency of 8%. Prior art discharge methods being used, there are great variations in the consistency of the pulp to be discharged, in practice between 0% and the cooking consistency. This causes great difficulties for washing apparatus, which are always designed to operate in a certain optimal consistency. Secondly, removal of the pulp from the digester using compressed air results in a great amount of air being mixed with the pulp. As is known, air causes difficulties for all pulp treatment processes. Three obvious disadvantages induced by use of air to the discharge from the digester are worth mentioning as examples. Firstly, it has been discovered that compressed air very easily blows a cavity through the pulp column to be discharged from the digester, causing thus a significantly great portion of the column to stay on the walls, supported by the bottom of the digester, whereby this portion cannot be removed from the digester at all. Secondly, use of compressed air causes mechanical damages in pipe systems and apparatus following the digester. Thirdly, as the concentration of air increases, also problems with foaming in washers and other following treatment apparatus increase. Thus, it is practically speaking irrational to allow air to mix with the pulp in this way. However, in order to minimize the following problem, even the above-described disadvantage has been accepted. Namely, since according to the prior art, only one pump takes care of pumping the pulp into each discharge tank, it would be important to get the pulp from the digester to the pump as quickly as possible. However, relatively long suction pipes from each digester to said pump cause resistance of flow and slow down the discharge of the tank. In practice, it usually takes approximately 15–30 minutes to empty one digester, naturally depending on the size of the digester.

According to the above article in Tappi Journal, the discussed method removes the disadvantages only partially. However, since the pump has been installed below the digester at a distance from the digester outlet in such a manner that an inlet piping leads from the gate valve at the digester outlet to the centrifugal pump, it has been found out, firstly, that the discharge of the pulp from the digester is not uniform, i.e. the pulp has to be "overdiluted" to make it flow out of the digester smoothly. In other words, when the dilution liquid is merely introduced to the bottom portion of the digester, there are no guarantees that it will be mixed with the pulp at all. There is a risk that the dilution liquid flows to the digester outlet without mixing with the pulp at all, in practice. Thereby, the pulp which is normally (while being digested) in medium consistency flows non-diluted down the discharge pipe, whereby the pulp very easily forms arch-like cavities which hamper the downward flow in the inlet piping. The consistency variations are large both in the cross-section of the pipe and in the horizontal direction. Secondly, the pump causes a suction which creates, at least from time to time, a subatmospheric pressure, i.e. cavitation, in the inlet pipe, which raises the temperature above the boiling point of the in-flowing liquid. Hereby, steam bubbles are created in the pulp, which steam bubbles hamper the pumping of the pulp. Also the high temperature in the discharge may decrease the pulp quality. Thirdly, due to the non-uniform, non-smooth flow of the pulp out of the digester there are pressure variations in both the inlet piping and the outlet piping of the pump. The results of the pressure variations have too often led to structural breakdowns of the components of the discharge system. Fourthly, the discharge time for emptying the digester has not been the shortest possible as the inlet piping has created in addition to the above mentioned problems also flow resistance which has decreased the discharge capacity. In other words, the article does not take into account the fact that the digested pulp which is in the form of substantially large lumps cannot flow smoothly along the inlet piping of the pump and is not able to level its consistency automatically when dilution liquid is introduced therein. It has to be remembered that there are normally no means for mixing the dilution liquid with the pulp at the digester bottom but the dilution liquid is sprayed through several nozzles into the pulp, whereby only a fraction of the pulp lumps will get into contact with the dilution liquid prior to entering the discharge opening and the inlet piping.

In order to eliminate the above-described problems, each batch digester unit is provided with a discharge pump of its own, which pumps are preferably arranged directly at the outlet opening of the digester.

According to one preferred embodiment, a pump is connected to the outlet of the digester without a valve between the digester and the pump. Of course, it would be possible to arrange the pump in the discharge line after the ordinary closing valve of a digester, but this is unnecessary, since experiments have shown that the digester can be reliably closed by means of a pump and a following control valve. Even if the pump connected to the outlet of the digester without a closing valve in the above-described manner went out of order for some reason, most digesters are provided with some feeding opening or the like, e.g. a blow opening for a knot fraction. The digester may, if necessary, be pressurized with compressed air, steam or the like through said opening, whereby it is possible to discharge pulp even through a pump out of order, the pulp being appropriately diluted.

In performed experiments it has been discovered that the consistency of the pulp to be discharged stays surprisingly uniform when using discharge by means of a pump according to the invention. One reason for this is the fact that immediately after the dilution liquid is introduced into the pulp at the digester bottom, the pulp enters the discharge pump, which efficiently mixes the dilution liquid with the pulp. This ensures the best possible flow characteristics for further flow of the pulp in the discharge pipeline. Naturally, mixing of air with the pulp is also totally prevented, since there is no need for discharge with compressed air. The most significant advantage, however, is that the discharge time drops to about half of what it used to be, i.e. to 6–15 minutes. The following example illustrates what can be achieved by said saving of time.

As is known, the retention time of the pulp in a batch digester is about 3 hours. If additional 30 minutes are required to empty the digester, the total cooking time is 3.5 hours, which means that 6.86 cooks can be performed within 24 hours. If the digester is emptied within 15 minutes, 7.38 cooks can be performed within 24 hours. In other words, compared with a prior art process, a process provided with a new kind of discharge is about 7% faster.

According to one aspect of the present invention a method of improving a batch cooking process using a batch digester having a bottom with an outlet, a pump dedicated to the batch digester and connected to the digester bottom outlet, and a discharge tank, the method comprising the steps of: (a) diluting the pulp with dilution liquid; and (b) pumping the diluted pulp from the digester outlet to the discharge tank using the dedicated pump. Typically the batch digester is one of a plurality of such digesters each having a dedicated pump connected to a bottom outlet thereof, and the discharge tank is common discharge tank. Step (b) is typically practiced for each of the plurality of batch digesters (either at the same time, or preferably one after the other) with a dedicated pump for each, to the common discharge tank.

The method also preferably comprises the further steps of: (c) after a desired amount of pulp has been pumped from a given batch digester during the practice of step (b), terminating operation of the dedicated pump associated with the given digester; and (d) positively closing off flow of the pulp from the pump to the common discharge tank. Typically the further step of pressurizing the discharge tank to a superatmospheric pressure, between 1–10 bar gauge, preferably between about 3–6 bar gauge, is provided, as well as the further step of maintaining the temperature in the discharge tank between 80°–140° C.

According to another aspect of the invention a method of improving a batch cooking process using a batch digester and a discharge tank, comprising the steps of: (a) Pressurizing the discharge tank to superatmospheric pressure. And, (b) discharging cellulose pulp from the batch digester to the superatmospheric pressure discharge tank. Step (a) is preferably practiced to pressurize the discharge tank to a superatmospheric pressure between 1–10 bar gauge, preferably between 3–6 bar gauge, and there is the further step of maintaining the temperature in the discharge tank between 80°–140° C. Also there preferably is the further step of effecting extraction or hot alkali extraction of the pulp in the discharge tank. Also a conventional pulp washer is typically provided and there is the further step of discharging the pulp from the discharge tank to a pulp washer substantially solely under the motive force provided by the superatmospheric pressure in the discharge tank. Also the digester preferably has a dedicated pump connected to a bottom outlet thereof, and step (b) is practiced by simultaneously diluting the pulp with treatment chemicals for effecting further treatment of the pulp, and pumping the diluted pulp from the digester outlet to the discharge tank, using the dedicated pump.

The invention also comprises an apparatus for improving a batch cooking process comprising: a batch digester having a bottom pulp outlet; and a discharge pump dedicated to the batch digester and attached directly to the digester outlet. The apparatus may further comprise a discharge tank; a pipe directly connecting the pump to the tank; and a valve for allowing or preventing pulp flow therethrough, the valve in the pipe between the pump and the tank. The discharge tank preferably comprises a common discharge tank, and preferably there further is provided a plurality of other batch digesters each having a bottom pump outlet and a discharge pump dedicated thereto and attached directly to the outlet, and a dedicated pipe connecting each to the common discharge tank. Alternatively each batch digester dedicated pump may be attached directly to the discharge tank or to a valve directly connected to the discharge tank (i.e. connected without any piping having a length over one meter). The pump may comprise a centrifugal pump or a fluidizing centrifugal pump.

According to another aspect of the present invention a batch digester is provided comprising: A substantially cylindrical upright vessel having a top with a chip and liquor feed, and a bottom with a pulp outlet. The outlet including a flange. And, a dedicated pump attached to the flange for discharging pulp from the vessel through the outlet, and for transferring the pulp to a discharge tank. The batch digester set forth above may be in combination with a plurality of other substantially identical batch digesters each having a dedicated pump, and the combination may further comprise a common discharge tank connected to all of the pump, directly or by conduits.

According to another aspect of the present invention a batch digester system is provided comprising: A substantially cylindrical upright vessel having a top with a chip and liquor feed, and a bottom with a pulp outlet; and said outlet including a flange. And, a superatmospheric pressure discharge tank, the digester outlet connected to the discharge tank. The system preferably further comprises a pulp washer; and a conduit connecting the discharge tank to the pulp washer without intermediate pumping, so that the superatmospheric pressure in the tank comprises substantially the only motive force for transferring pulp from the tank to the washer. A dedicated pump may be attached to the flange of the digester as described above, and a valve may be provided directly connected to the pump and the valve directly connected to the discharge tank, or through piping.

It is the primary object of the present invention to provide a method and system for improving the batch cooking process. This and other objects of the invention will become clear from an inspection of the detailed description of the invention, and from the appended claims.

DETAILED DESCRIPTION OF THE DRAWINGS

Figure 1:
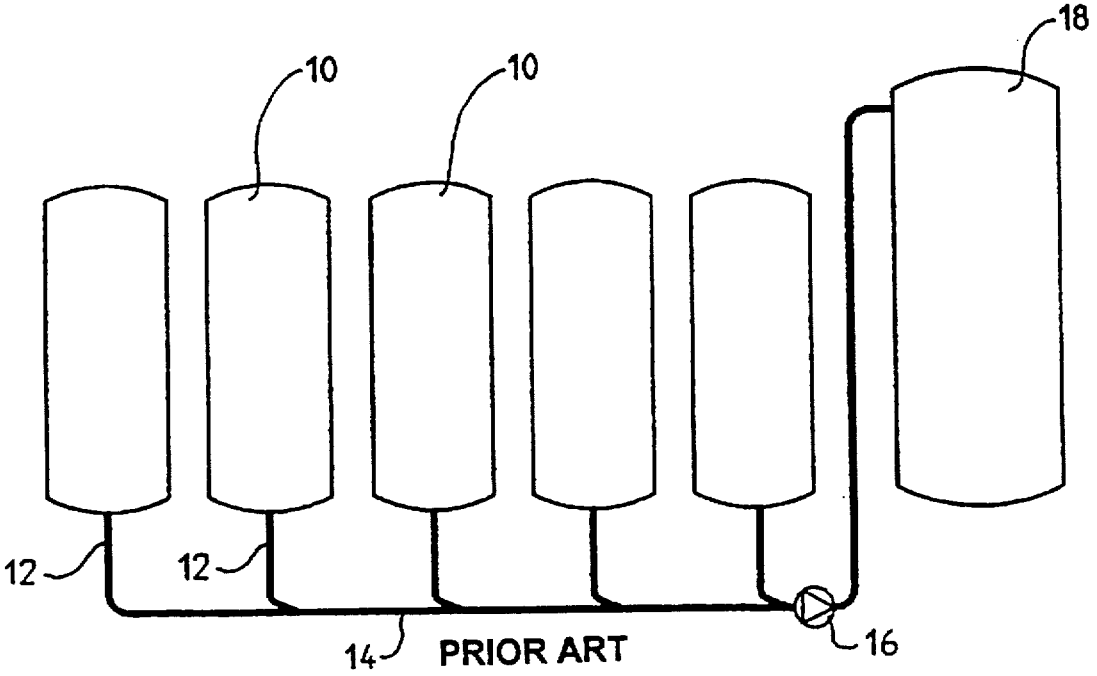
FIG. 1 illustrates a batch digester system according to the prior art.

A prior art batch digester system according to FIG. 1 comprises a set of batch digester units 10 connected in parallel, which are attached to a common discharge line 14 by means of discharge pipes 12 characteristic of each digester, correspondingly. In the discharge line 14, there is a pump 16 between the discharge pipes 12 and the discharge tank 18, by means of which pump the pulp coming from all digester units 10 is pumped into the discharge tank 18. The digester 10 being about 10 meters by diameter, the distance of the farthest-off digester from the pump 16 is most often over 50 meters, whereby it is obvious that the flow of thick pulp in the pipe system is slow. It is also obvious that relatively high pressure has to be used in the digester so that it is even possible to make the pulp flow as far as to the pump 16.

Figure 2:
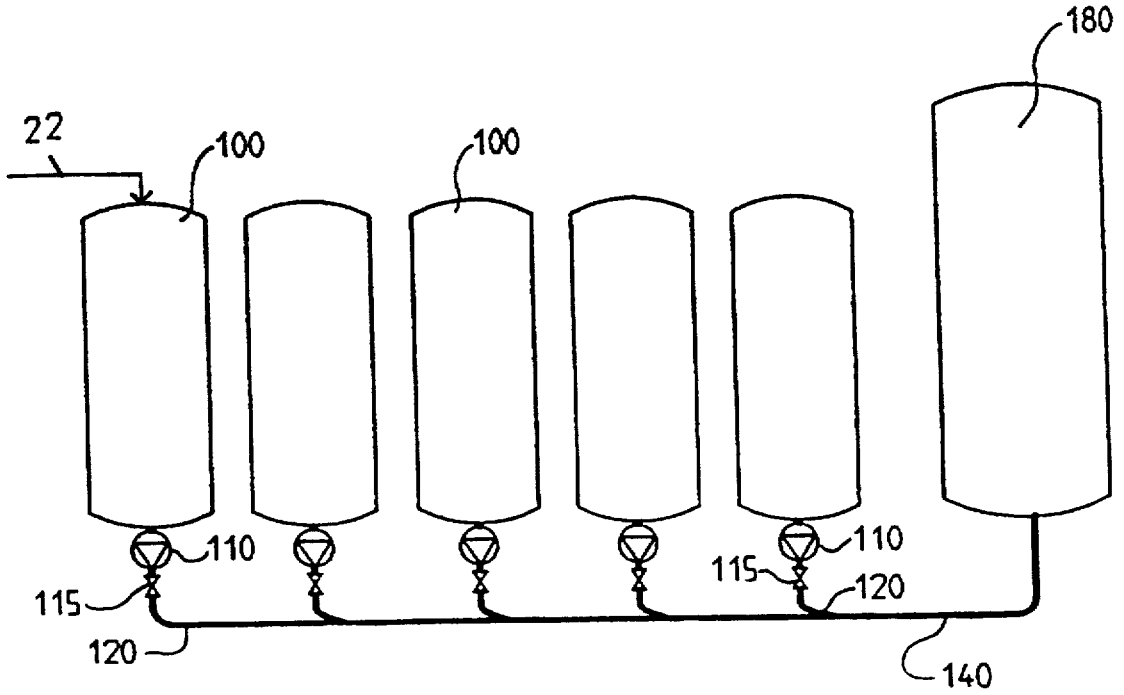
FIG. 2 illustrates a batch digester system according to one preferred embodiment of the invention.

In FIG. 2, an arrangement according to one preferred embodiment of the invention is illustrated, in which each conventional batch digester unit 100 is formed by a substantially cylindrical upright vessel, the top end of which comprises at least feeding apparatus (shown schematically at 22 for only one digester 100) for chips and cooking liquor, and in the half-spherical or spherical calotte shaped bottom end of which at least an outlet and the flange thereof are arranged for discharging the cooked pulp from the digester. Each batch digester 100 is provided with a dedicated pump 110 (i.e. a pump of its own), located between the digester 100 and the discharge pipe 120. The pump 110 may be located at the digester bottom in such a way that a closing valve is arranged between the digester 100 and the pump 110. However, according to one preferred embodiment of the invention, the discharge pump 110 is attached directly to the outlet flange of the digester without a closing valve, whereby the pump acts at rest, i.e. when being stopped during the intervals between discharges of the digester, as a valve closing the bottom of the digester together with the control valve 115 following the pump. Said pump may be a centrifugal pump if the consistency of the pulp is sufficiently low, so that the pump is capable of pumping such, or a fluidizing centrifugal pump if the consistency of the pulp is higher. In operation the discharge pump is used for mixing dilution liquid with the pulp to be discharged from the digester in such a manner that the discharged pulp is uniform whereby there are, in practice, no variations in the consistency.

FIG. 2 illustrates how, in a conventional manner per se, the discharge pipe 120 of each digester is connected to the discharge line 140 shared by all digesters 100 of the same set, which discharge line ends at the discharge tank 180.

Figure 3:
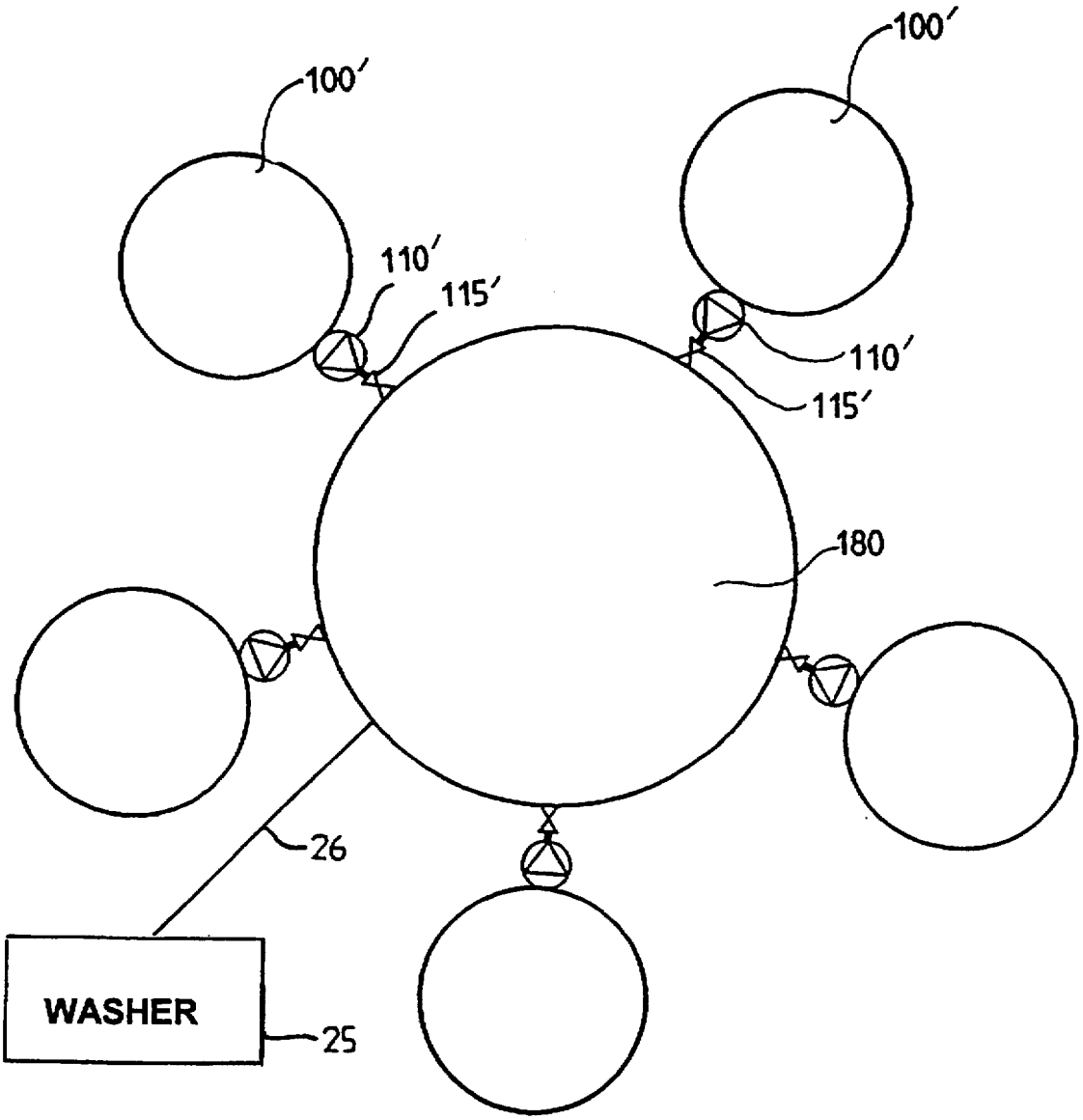
FIG. 3 illustrates a batch digester system according to another preferred embodiment of the invention.

FIG. 3 illustrates another embodiment, in which the discharge tank 180' shared by the digesters 100' is located in the middle of the digester set in such a way that a discharge pipe 120' leads from each digester 100' directly to the discharge tank 180'. Naturally, a pump control valve system 110', 115' according to the invention is used in this embodiment, too. In other words, each digester 100' or the discharge pipe 120' thereof is provided with a pump 110' to pump the pulp from the digester 100' to the discharge tank 180'. The valves 115' are directly connected to the tank 180, i.e. without any piping having a length over one meter; each of the pumps 110' are similarly directly connected to a digester 100', i.e. without any piping having a length over one meter.

An arrangement according to the invention also enables the discharge tank 180 to be pressurized, i.e. at superatmospheric pressure. Thus, the discharge tank can be utilized for e.g. after-cooking of the pulp, as well as to extraction, preferably hot alkali extraction (disclosed in e.g. U.S. Pat. No. 4,971,658). The pressurized discharge tank is especially suitable for hot alkali extraction, since the pulp, coming out from the digester in the form of chips, will degrade into fibers, whereby the extraction is especially efficient. The chemicals needed for various after-treatments may be brought into contact with the pulp preferably through a discharge pipe, even though it is naturally possible to provide each discharge pipe 120 or discharge line 140 with a mixer designed especially for this purpose. Depending on the kind of the treatment, the pressure in the tank is approximately 1–10 bar gauge, preferably between about 3–6 bar gauge, the temperature being 80°–140° C. The consistency of the pulp in the tank is preferably at the low end of medium-consistency range, i.e. approximately 6–10%, more suitably about 7–8%.

The system of FIG. 3 further comprises a conventional pulp washer 25 connected by a conduit 26 to the tank 180. While valves may be provided in conduit 26 there is no need for a pump or the like because the superatmospheric pressure (e.g. about 3–6 bar gauge) in the 180 provides substantially the only motive force (e.g. gravity may provide a slight assist) moving the pulp (e.g. at a consistency of about 6–10%) from the tank 180 to the washer 25.

An atmospheric tank may be utilized not only for the after-treatment but also in such a way that the pulp is discharged from the tank to the washer at a high temperature and pressure. Hereby, especially preferable washer alternatives are a DrumDisplacer® washer of AHLSTROM MACHINERY CORPORATION or a pressure diffuser of AHLSTROM MACHINERY INC., both of which endure temperatures up to 120° C. and pressure up to 10 bar gauge.

Figure 4:
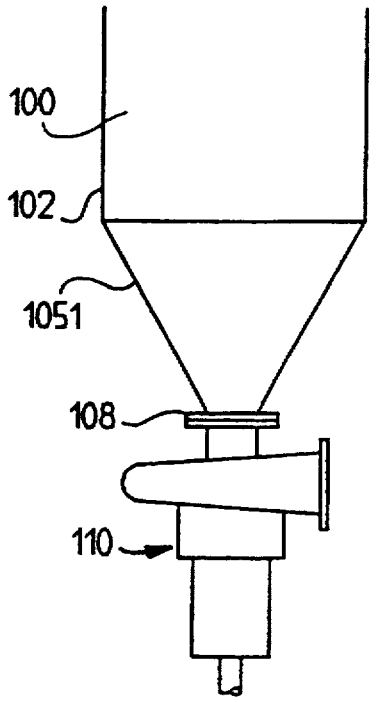
FIGS. 4 through 15 illustrate different preferred embodiments of the invention.
Figure 5:
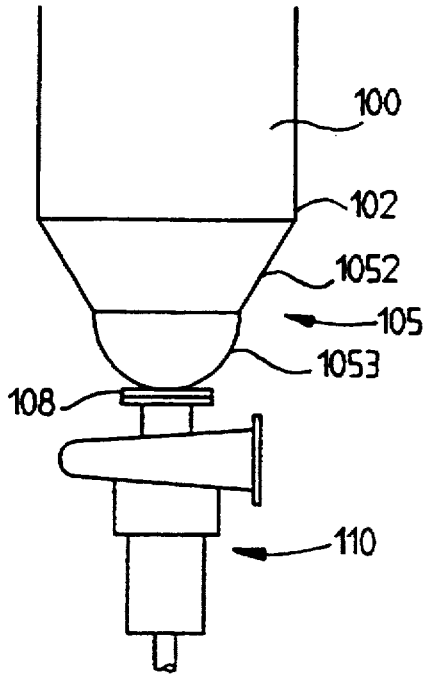
Figure 6:
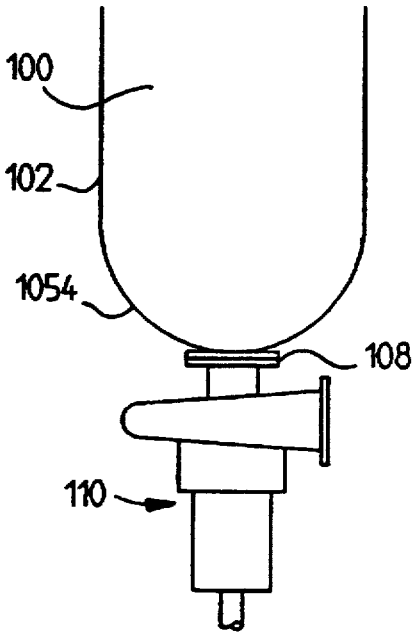
Figure 7:
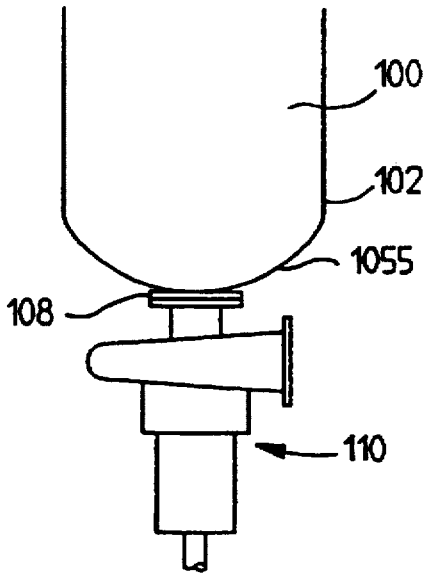
Figure 8:
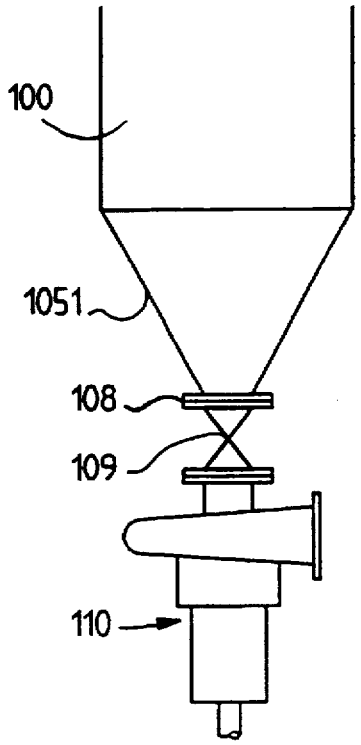
Figure 9:
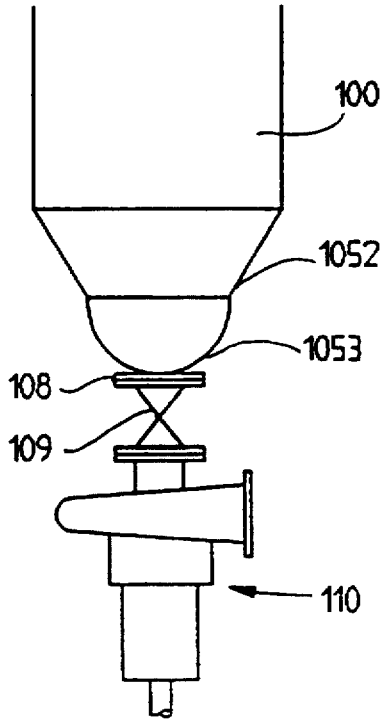
Figure 10:
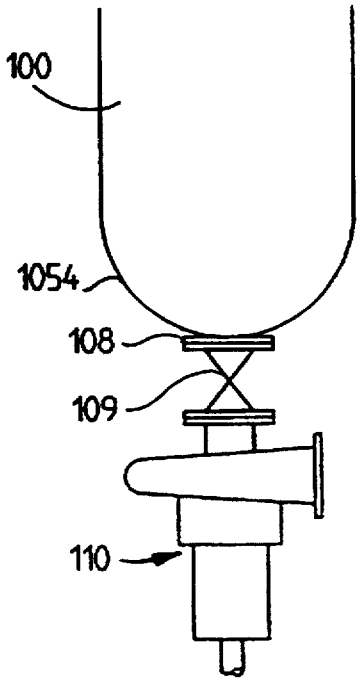
Figure 11:
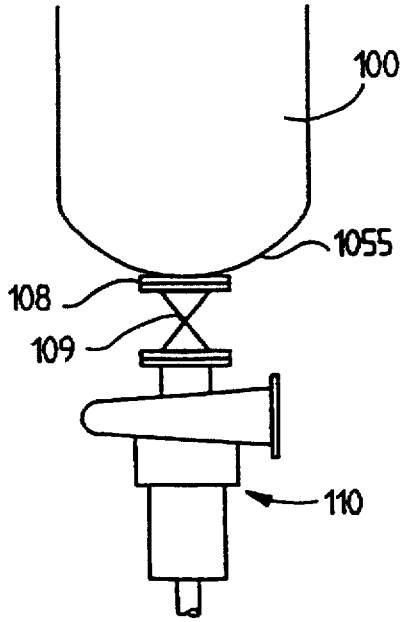
Figure 12:
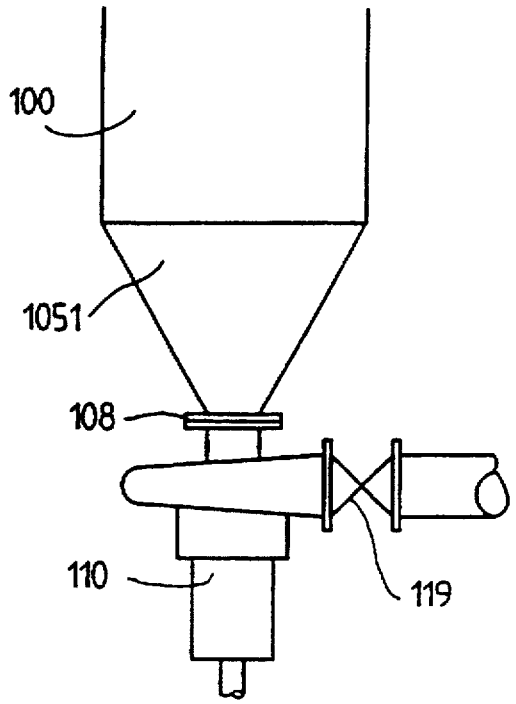
Figure 13:
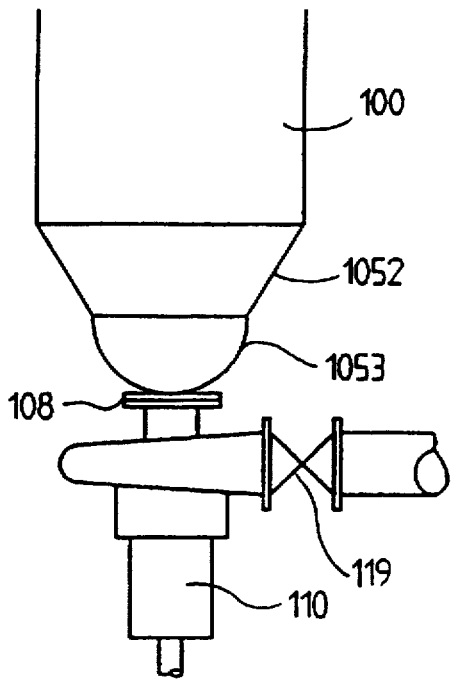
Figure 14:
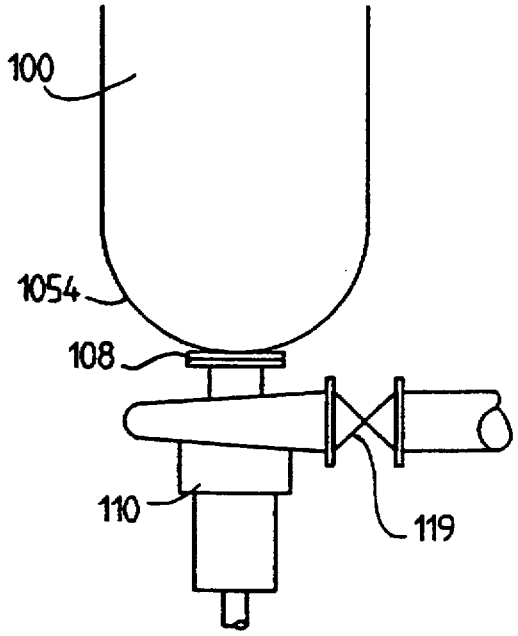
Figure 15:
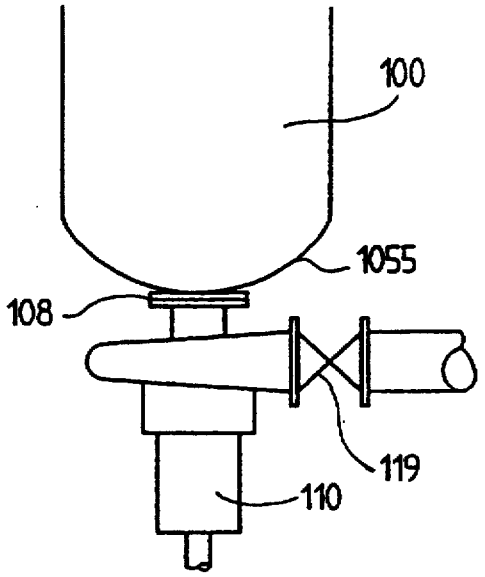

FIGS. 4 through 15 illustrate different preferred embodiments of the invention. More specifically FIGS. 4 through 7 show a few alternatives for the shape of the digester 100 bottom 105 and a way how a discharge pump 110 is attached to the digester 100 bottom 105. In FIG. 4 the digester 100 has a conical bottom 1051 the upper, and wider, end of which is attached to the generally cylindrical wall 102 of the digester 100. The lower end of the conical bottom 1051 is provided with a flange 108 to which a pump 110 is fastened. In FIG. 5 the digester 100 bottom 105 is formed of a truncated cone portion 1052 the upper, and wider, end of which is attached to the generally cylindrical wall 102 of the digester 100 and to the lower end of which a half spherical member 1053 is attached. the half spherical member 1053 is provided with a flange 108 to which a pump 110 is fastened. In FIG. 6 the digester 100 bottom 1054 is half spherical and the flange 108 for the attachment of the pump 110 is arranged to the half spherical bottom portion 1054. In FIG. 7 the digester 100 bottom 1055 is of ball calotte shape i.e. resembling the shape of a pressure vessel. Again the bottom 1055 is provided with a flange 108 for the pump 110.

The embodiments shown in FIGS. 8 through 11 correspond to the above described ones but show a valve 109 arranged between the digester bottom flange 108 and the pump 110.

The embodiments illustrated in FIGS. 12 through 15 correspond to the embodiments shown in FIGS. 4 through 7 but show a valve 119 arranged at the pressure outlet of the pump 110.

It is yet to be understood that also other shapes of digester bottoms may as well be used in connection with the present invention as the actual shape of the bottom does not have a crucial effect on the location of the discharge pump. Also it should be noted that the embodiments of FIGS. 8 through 11 and the ones of FIGS. 12 through 15 may be combined i.e. in some instances it may be worthwhile having a closing valve at the digester bottom outlet upstream of the pump and another valve at the pressure outlet of the pump or at the pressure conduit introducing pulp from the pump forward. In this kind of an embodiment valve 109 could be used as an emergency valve which is closed only when the pump for some reason has to be removed.

As disclosed above, a totally new kind of method and apparatus have been developed for emptying of a batch digester. It is worth noting that the method and apparatus described not only eliminate disadvantages caused by prior art methods and apparatus, but also bring about new process possibilities previously out of reach. Only a preferred embodiment of the method and apparatus according to the invention is described above, which embodiment is by no means intended to restrict the invention from what is disclosed in the appended claims, which alone define the scope of the invention.

What is claimed is:

1. A method of improving a batch cooking process using a plurality of batch digesters each having a dedicated pump connected to a bottom outlet thereof and to a common discharge tank, said method comprising the steps of: (a) diluting the pulp with dilution liquid; and (b) for each of the plurality of digesters pumping the diluted pulp from the digester outlet to the common discharge tank using the dedicated pump for each digester.

2. A method as recited in claim 1 comprising the further steps of: (c) after a desired amount of pulp has been pumped from a given batch digester during the practice of step (b), terminating operation of the dedicated pump associated with the given digester; and (d) positively closing off flow of the pulp from the pump to the common discharge tank.

3. A method as recited in claim 2 wherein each dedicated pump is directly connected to a digester bottom outlet, and wherein step (b) is practiced by pumping directly from the digester outlet.

4. A method as recited in claim 1 comprising the further step of pressurizing the discharge tank to a superatmospheric pressure between 1–10 bar gauge, and maintaining the temperature in the discharge tank between 80°–140° C.

5. A method as recited in claim 1 wherein each dedicated pump is directly connected to a digester bottom outlet, and wherein step (b) is practiced by pumping directly from the digester outlet.

6. A method of improving a batch cooking process using a batch digester and a discharge tank, comprising the steps of:

(a) pressurizing the discharge tank to superatmosphereic pressure;

(b) discharging cellulose pulp from the batch digester to the superatmospheric pressure discharge tank; and (c) discharging the pulp from the discharge tank directly to a pulp washer substantially solely under the motive force provided by the superatmospheric pressure in the discharge tank.

7. A method as recited in claim 6 wherein step (a) is practiced to pressurize the discharge tank to a superatmospheric pressure between 1–10 bar gauge.

8. A method as recited in claim 7 comprising the further step of maintaining the temperature in the discharge tank between 80°–140° C.

9. A method as recited in claim 6 comprising the further step of effecting extraction or hot alkali extraction of the pulp in the discharge tank.

10. A method as recited in claim 9 wherein the digester has a dedicated pump directly connected to a bottom outlet thereof, and wherein step (b) is practiced by simultaneously diluting the pulp with treatment chemicals for effecting further treatment of the pulp, and pumping the diluted pulp directly from the digester outlet to the discharge tank, using the dedicated pump.

11. A method as recited in claim 6 wherein the digester has a dedicated pump directly connected to a bottom outlet thereof, and wherein step (b) is practiced by simultaneously diluting the pulp with treatment chemicals for effecting further treatment of the pulp, and pumping the diluted pulp directly from the digester outlet to the discharge tank, using the dedicated pump.

12. A method as recited in claim 11 wherein step (a) is practiced to pressurize the discharge tank to a superatmospheric pressure between about 3–6 bar gauge.

13. A method as recited in claim 6 wherein step (a) is practiced to pressurize the discharge tank to a superatmospheric pressure between about 3–6 bar gauge.

14. Apparatus for improving a batch cooking process comprising: a common discharge tank; and plurality of other batch digesters, each having a bottom pulp outlet and a discharge pump dedicated thereto and directly connected to said outlet; and wherein all of said pumps are directly connected to said common discharge tank.

15. A batch digester comprising:

a substantially cylindrical upright vessel having a top with a chip and liquor feed, and a bottom with a pulp outlet;

said outlet including a flange; and a dedicated pump attached to said flange for discharging pulp from said vessel through said outlet, and for transferring the pulp to a discharge tank wherein the batch digester is in combination with a plurality of other substantially identical batch digesters, each having a dedicated pump; and further comprising a common discharge tank connected to all of said pumps.

16. A batch digester comprising:

a substantially cylindrical upright vessel having a top with a chip and liquor feed, and a bottom with a pulp outlet;

said outlet including a flange; and a valve attached to said flange, and a pump attached to said valve, for discharging pulp from said vessel through said outlet wherein the batch digester is in combination with a plurality of other substantially identical batch digesters, each having a dedicated pump; and further comprising a common discharge tank connected to all of said pumps.

* * * * *